US005501788A

United States Patent [19]

Romine et al.

[11] Patent Number: 5,501,788

[45] Date of Patent: Mar. 26, 1996

[54] SELF-STABILIZING PITCH FOR CARBON FIBER MANUFACTURE

[75] Inventors: H. Ernest Romine; Edward J. Nanni; Mark W. Carel; W. Mark Southard, all of Ponca, Okla.

[73] Assignee: Conoco Inc., Ponca City, Okla.

[21] Appl. No.: 266,286

[22] Filed: Jun. 27, 1994

[51] Int. Cl.[6] ..... C10C 1/18; C10C 3/02

[52] U.S. Cl. ..... 208/45; 208/22; 208/39; 423/447.4; 264/DIG. 19

[58] Field of Search ..... 208/22, 39, 45; 423/447.4; 264/DIG. 19

[56] References Cited

U.S. PATENT DOCUMENTS

| | | | |
|---|---|---|---|
| 3,595,946 | 7/1971 | Joo et al. . | |
| 3,718,493 | 2/1973 | Joo et al. . | |
| 3,959,448 | 5/1976 | Fuller et al. . | |
| 4,066,737 | 1/1978 | Romovacek . | |
| 4,243,512 | 1/1981 | Seo . | |
| 4,277,324 | 7/1981 | Greenwood . | |
| 4,320,107 | 3/1982 | Oyabu et al. . | |
| 4,474,617 | 10/1984 | Uemura et al. . | |
| 4,497,789 | 2/1985 | Sawran et al. . | |
| 4,631,181 | 12/1986 | Matsumoto et al. | 423/449 |
| 4,671,864 | 6/1987 | Sawran et al. . | |
| 4,818,612 | 4/1989 | Hara et al. | 423/447.1 |
| 4,927,620 | 5/1990 | Ward et al. . | |
| 5,032,250 | 7/1991 | Romine et al. | 208/39 |
| 5,182,010 | 1/1993 | Mochida et al. | 208/44 |
| 5,259,947 | 11/1993 | Kalback et al. . | |

FOREIGN PATENT DOCUMENTS

| | | |
|---|---|---|
| 0065090 | 4/1985 | Japan . |

*Primary Examiner*—Helane Myers
*Attorney, Agent, or Firm*—William D. Hall

[57] ABSTRACT

This invention provides a process for preparing a solvated isotropic pitch having a fluid temperature at least 40° C. lower than the same pitch in the non-solvated state. Additionally, the present invention provides a solvated isotropic pitch which may be formed into carbon artifacts which do not require oxidative stabilization prior to carbonization.

27 Claims, 1 Drawing Sheet

Figure 1. Conventional and Solvated Pitch Fiber Processes
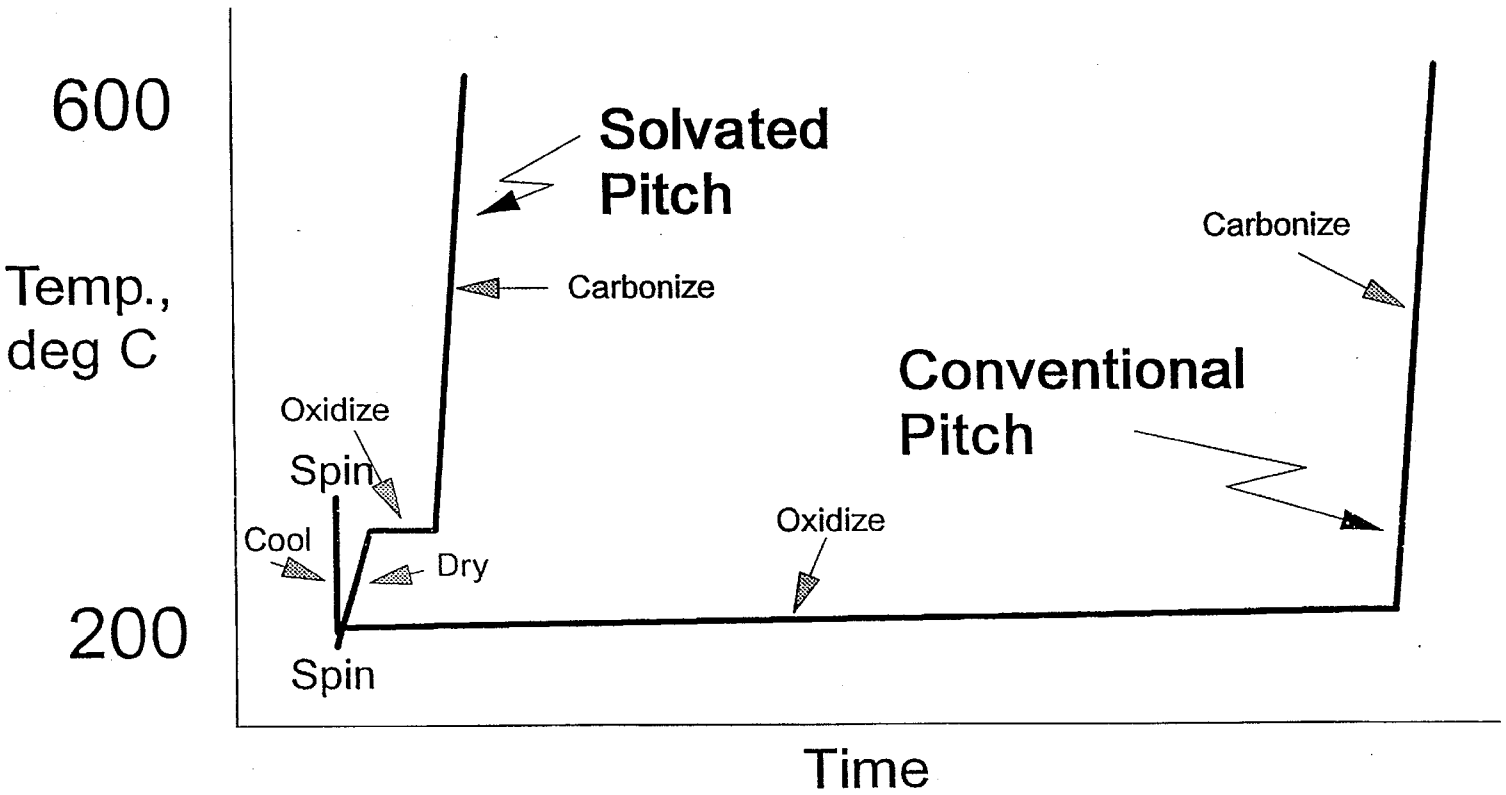

SELF-STABILIZING PITCH FOR CARBON FIBER MANUFACTURE

BACKGROUND AND SUMMARY

This application relates to the discovery that high melting isotropic pitches can be converted to solvated isotropic pitches thereby lowering the effective melting point of the pitch. Solvated pitches prepared by the disclosed process may be spun into fibers which require little or no stabilization treatment.

The processes for spinning traditional non-solvated isotropic pitches are well known. Currently Kureha Chemical Industry Co. is the leading producer with a capacity of 900 tons/year. Additional manufacturers include Ashland Oil Co. and Kawasaki Steel Company.

Isotropic carbon fibers are commonly used as reinforcement for concrete structures. In this aspect, carbon fibers must compete with steel and fiberglass fibers. Therefore, it is desirable to provide carbon fibers at the lowest cost possible. In the process of manufacturing carbon fibers, one of the slowest and costliest steps is the stabilization (usually by oxidation) of the as-spun fiber prior to the carbonization of the fiber. The stabilization step is necessary to preclude melting of the fiber during the carbonization process which occurs at temperatures in excess of 350° C. and frequently higher than 1000° C. In order to reduce the time and cost of this step, one preferably manufactures fibers from high melting pitches. However, prior to the present invention, those pitches which melted above the spinning temperature were unusable.

Therefore, one of the objects of the present invention is to provide a process for manufacturing carbon fibers which do not require oxidation prior to stabilization. Additionally, the present invention provides a solvated isotropic pitch which has a fluid temperature at least 40° C. lower than the melting point of the same pitch in the non-solvated state. Further, the present invention provides a solvated pitch which can be spun into a fiber, devolatized and oxidatively stabilized at a temperature equal to or greater than the spinning temperature.

Definitions

For the purposes of this specification and claims, the following terms and definitions apply:

"Pitch" as used herein means substances having the properties of pitches produced as by-products in various industrial production processes such as natural asphalt, petroleum pitches and heavy oil obtained as a by-product in a naphtha cracking industry and pitches of high carbon content obtained from coal.

"Petroleum pitch" means the residual carbonaceous material obtained from the catalytic and thermal cracking of petroleum distillates or residues.

"Petroleum coke" means the solid infusible residue resulting from high temperature thermal treatment of petroleum pitch.

"Isotropic pitch" means pitch comprising molecules which are not aligned in optically ordered liquid crystal.

"Anisotropic pitch" or "mesophase pitch" means pitch comprising molecules having aromatic structures which through interaction are associated together to form optically ordered liquid crystals, which are either liquid or solid depending on temperature.

"Mesogens" means molecules which when melted or fused form mesophase pitch and comprise a broad mixture of large aromatic molecules which arrange upon heating to form liquid crystals.

"Pseudomesogen" means materials which are potentially mesophase precursors, but which normally will not form optically ordered liquid crystals upon heating, but will directly form a solid coke upon heating, such that there is no melting or fusing visible.

"Fluid temperature" for a solvated pitch is determined to be the temperature at which a viscosity of 6000 poise is registered upon cooling of the solvated pitch at 1° C. per minute from a temperature in excess of its melting point. If the melting point of a solvated pitch could be easily determined, it would always be lower than the fluid temperature.

"Solvated pitch" means a pitch which contains between 5 and 40 percent by weight of solvent in the pitch which has a fluid temperature of at least 40° C. lower than the melting point of the pitch component when not associated with solvent.

"Fibers" means lengths of fiber capable of formation into useful articles.

"Oriented Molecular Structure" means the alignment of mesophase domains in formed carbon-containing artifacts, which alignment corresponds to the axis of the artifact and provides structural properties to the artifact.

"Solvent Content" when referring to solvated pitch is that value determined by weight loss on vacuum separation of the solvent. In this determination, a sample free of entrained or trapped solvent is accurately weighed, crushed and heated in a vacuum oven at less than 5 mm pressure and at a temperature of 150° C. for one hour. The percent solvent content is the weight loss or difference in weight times 100 divided by the original sample weight.

"Oxidation/Stabilization" is the process of making a pitch artifact infusible or unmeltable by reacting the artifact with oxygen or an oxidizing agent.

"Softening and Melting points" are determined by heating a sample at about 5° C./minute on a hot stage microscope under an inert atmosphere. The softening point for a dried pitch is the first rounding of angular features of the pitch particles. The melting point for a dried pitch is that temperature at which the first observable flow of the softened pitch is seen.

BRIEF DISCLOSURE OF THE INVENTION

This invention provides a solvated isotropic pitch and a process for preparing a solvated isotropic pitch. Additionally, this invention provides low cost carbon artifacts which have unique stabilization properties and high melting temperatures. Further, the present invention provides carbon fibers in which any mesophase domains present are not highly stretched or elongated along the axis of the fiber.

A typical process for preparing a solvated isotropic pitch comprises mixing the components together to form a soluble solvent phase and an insoluble pitch phase. Preferably the mixing process occurs at a temperature sufficient to maintain all phases in the liquid state, whereafter the system is allowed to settle. During the settling of the system, phase separation occurs. Following phase separation, the solvated isotropic pitch is recovered by removal of the liquid solvent phase under conditions which do not destroy the solvated isotropic pitch.

The solvated isotropic pitch of the present invention will have less than 40% optical anisotropy (mesophase) by volume. However, it should be understood that drying of the pitch to remove the solvent may generate additional mesophase. Further, the solvated isotropic pitch of the present invention will have a fluid temperature at least 40° C. lower than the melting point of the same pitch without solvent. Additionally, the solvated isotropic pitch of the present invention will have at least 5% by weight toluene insolubles. Finally, depending upon the composition of the feed pitch, the solvated isotropic pitch of the present invention will either 1) be automatically self-stabilizing upon removal of solvent, or 2) may be stabilized at temperatures above its fluid temperature in relatively short time periods.

The present invention also provides a process for preparing carbon artifacts from a solvated isotropic pitch. This process includes the steps of preparing a solvated isotropic pitch and further includes the step of forming a carbon artifact. Presently, the most common carbon artifact is a carbon fiber. The process of preparing carbon artifacts may optionally include a solvent exchange step wherein the solvent used to prepare the solvated isotropic pitch is replaced with a solvent more suitable for preparing carbon artifacts.

Finally, the present invention provides carbon artifacts having unique self-stabilizing or improved stabilization characteristics. The most preferred carbon artifacts of the present invention are those artifacts which, on loss of solvent following formation, can be heated to carbonization temperatures without melting. Thus, the present invention provides carbon artifacts which do not require a chemical infusibilization step prior to carbonization.

Alternatively, the present invention provides carbon artifacts which may be stabilized at temperatures greater than the fluid temperature of the solvated pitch via the steps of artifact formation, solvent removal and artifact stabilization. Further, the time required to stabilize the carbon artifacts of the present invention is reduced when compared to previous carbon artifacts. Additionally, any mesophase present in the carbon artifacts of the present invention tends to develop on solvent loss following artifact formation. As this mesophase develops after artifact formation, it is not highly elongated by the shear forces associated with artifact formation.

BRIEF DISCLOSURE OF THE FIGURE

FIG. 1 is a graph comparing the oxidative stabilization of conventional pitch to a solvated pitch.

DETAILED DISCLOSURE OF THE INVENTION

I. Preparation of Solvated Isotropic Pitch

Preparation of a solvated isotropic pitch begins with choosing an appropriate feed pitch. Pitches suitable for use in this invention will have a composition by weight of about 88% to 96% carbon, up to about 12% hydrogen and no more than 6% of sulfur, oxygen, nitrogen or other components. Preferably, a majority of the pitch molecules will be aromatic. Further, the pitch should have a low concentration of flux insolubles. Preferably, the pitch will have less than 20% flux insolubles. If necessary, filtering of the pitch before or after solvating may be performed to achieve an appropriate level of insolubles. Alternatively, the pitch may be fluxed with an organic fluxing agent such as toluene, chloroform or tetrahydrofuran followed by physical separation of the flux insolubles. These flux insolubles typically comprise pitch impurities such as ash and inorganic compounds. In some instances, very high melting organic compounds may also be removed as flux insolubles. In general, a pitch having less than 30% quinoline insolubles (QI) by weight will be suitable; however, preferred pitches will have between 0% and 10% QI. Typically, these pitches will have melting points ranging from about 150° C. to about 300° C.

An additional parameter for suitable pitches is the degree of insolubility in solvents such as toluene. In general, the feed pitch must contain at least 5% by weight toluene insolubles in order to yield a solvated isotropic pitch product. Preferably, the feed pitch will contain at least 20% by weight toluene insolubles. In contrast to flux insolubles, toluene insolubles are commonly organic compounds which require a stronger solvent to become solubilized. Pitches which meet the foregoing requirements include synthetic, coal, petroleum and ethylene tar pitches. Commercially available pitches include Ashland A240 pitch, heat treated Ashland A240 and Ashland Aerocarb pitches.

The choice of an appropriate solvating solvent is equally important in the present invention. Suitable solvents typically have solubility parameters in the range of 8.0 to 11.0. The term solubility parameter is defined as:

$$\rho = \left( \frac{H_v - RT}{V} \right)^{1/2}$$

where $H_v$=heat of vaporization

R=molar gas content

T=temperature in °K.

V=molar volume.

For a discussion on solubility parameter, please see *Solubility of Non-Electrolytes,* 1948, J. Hildebrand and R. Scott, incorporated herein by reference. Solvents found to be useful in the present invention include benzene, toluene, xylenes, tetralin. Further, other substantially aromatic solvents such as heteroaromatics (e.g. quinoline and pyridine) and 1 to 3 ring aromatic compounds and their partially hydrogenated or alkylated derivatives may be used in the present invention. Additionally, substantially aromatic blends of aromatic and paraffinic solvents such as heptane are useful in the present invention. In general, suitable solvents will produce from one-fourth to twice the amount of heavy pitch insolubles as the amount of heavy pitch insolubles produced by toluene. For the purposes of this disclosure, solubility is measured by combining one gram of pitch with 25 milliliters of solvent at ambient conditions.

The process of the present invention combines pitches and solvents, as described above, to provide a solvated isotropic pitch. According to the process of the present invention, an isotropic pitch is mixed with a solvent for a period of about one hour at a temperature sufficient to convert all phases in the mixture to liquids and at a sufficient pressure to preclude boiling. Following mixing, the pitch/solvent system is allowed to settle and cool. During this step, phase separation occurs producing a liquid solvent phase and a solvated pitch phase. Depending upon equipment, settling will usually be completed in about five to thirty minutes. If necessary, mechanical processes such as centrifuging may be used to hasten phase separation. Following phase separation, the solvated pitch is recovered either as a liquid or one may cool the mixture and recover the pitch as a precipitated solid. In either instance, conventional recovery methods such as decanting the liquid phase or filtering to remove the solid solvated pitch will be suitable. Alternatively, one may continuously recover the solvated pitch and solvent phase in the liquid state. If necessary, the recovered solvated pitch, while in the liquid state, may be filtered to remove contaminants.

Alternatively, solvated pitch can be obtained by forming the same combination of isotropic feed pitch and solvent at a lower temperature such that the solvent phase is liquid and the solvated pitch phase is a solid. When this method is used, the solid solvated pitch can be recovered by conventional means such as filtering.

The properties of the non-volatile portion of a solvated pitch may be measured by drying the solvated pitch for about 60 minutes at a temperature of about 150° C. to remove the solvent. Following drying of the pitch, the softening and melting points can be determined by heating on a hot stage microscope under an inert atmosphere at about 5° C./minute. After solvent removal, the pitches of the present invention will normally have a softening point of at least 280° C. Harder dried pitches will soften at temperatures greater than 500° C.; however, these pitches will not melt when heated at 5° C. per minute in an inert atmosphere. These pitches are considered to be self-stabilizing since they will carbonize directly to carbon artifacts on continuous heating.

II. Solvated Isotropic Pitches

The solvated isotropic pitches of the present invention provide several significant advantages over non-solvated isotropic pitches. In general, the solvated pitch will contain from about 5% to about 40% solvent by weight. Further, the solvated pitch has at least 50% toluene insolubles by weight and may be composed of up to 40% optical anisotropy by volume. Upon removal of solvent from the pitch, the anisotropic content may increase. The solvated isotropic pitch of the present invention has a fluid temperature at least 40° C. lower and in some cases more than 100° C. lower than the melting point of the same pitch in a non-solvated state, i.e. the dry pitch.

III. Process for Preparing Carbon Artifacts

The present invention further provides a process for manufacturing carbon artifacts from solvated isotropic pitches. In particular, the present invention provides a process for making carbon fibers from solvated isotropic pitch. The process of preparing carbon artifacts from solvated isotropic pitches begins with a solvated isotropic pitch.

Depending on the artifact to be formed and the solvent used to solvate the pitch, the manufacturing process may require replacement of the solvating solvent with a solvent compatible with the manufacturing process. This step, known as solvent exchange, may be accomplished several ways. One method requires drying of the solvated pitch to drive off the solvent, followed by resolvating the pitch with a suitable solvent. An alternative method provides for adding to the solvated pitch a solvent having a higher boiling point than the initial solvating solvent. Subsequently, this mixture is heated to boiling to remove the lower boiling solvent leaving a solvated pitch containing the higher boiling solvent. Regardless of the method, typical .manufacturing solvents will have a solubility parameter of about 8 to about 12 and possibly higher. The manufacturing solvents may, non-exhaustively, include one or more of the following solvents: toluene, benzene, xylene, tetralin, tetrahydrofuran, chloroform, heptane, pyridine, quinoline, halogenated benzenes, chlorofluorobenzenes, and 2 to 4 ring aromatic solvents and their partly alkylated and hydrogenated derivatives.

Once the solvated pitch contains a solvent suitable for the manufacturing process, it may be formed into a carbon artifact by methods well known in the art. Presently, the most common carbon artifact is the carbon fiber.

In the process of spinning carbon fibers from solvated pitch, a portion of the solvent will be lost from the product fiber. Following spinning, any remaining solvent is readily removed by drying of the fibers. The loss of solvent produces a carbon fiber which has a softening point of at least 280° C. Further, the resulting fiber will have a melting point greater than the spinning temperature of the fiber. Finally, depending upon the initial feed pitch, the resulting fibers will not require additional treatment before carbonization.

Dried fibers which have softening temperatures greater than the 350° C. onset temperature can be carbonized without prior stabilization. Preferably, the fibers will have softening points greater than 500° C. Carbonization is achieved by heating the fibers at a temperature slightly lower than the softening point of the fibers. As carbonization of the fiber progresses, the softening temperature of the fiber rises allowing for a corresponding increase in the temperature of the carbonization reaction. However, the fibers are never heated above their softening point during the carbonization reaction. For fibers with softening points greater than 500° C. heating may progress at a rate of 20° C. per minute or faster without softening the fiber. In general, carbonization is completed upon heating at 600° C. However, one may treat the fibers at even higher temperatures.

For pitches with softening points between about 280° C. and 500° C., oxidative stabilization may be preferable prior to carbonization. Additionally, under certain circumstances, one may desire to oxidatively stabilize pitches with softening points greater than 500° C.

One advantage of the present invention is the ability to oxidatively stabilize the pitch and/or carbon artifacts made from the pitch quickly at relatively high temperatures and relatively low oxygen concentrations. Specifically, stabilization may be achieved at temperatures greater than the artifact formation temperature and in atmospheres containing less than 5% oxygen. The advantages of the present invention over previous methods of oxidative stabilization are demonstrated by Example 2 and FIG. 1. FIG. 1 compares the oxidative stabilization of a conventional pitch to a solvated pitch. As demonstrated by FIG. 1, the solvated pitch does not require cooling prior to the oxidative stabilization and stabilization occurs at generally higher temperatures in a shorter period of time. Thus, the present invention provides a significant safety advantage over the prior art by eliminating the flammability risk involved with oxidative stabilization.

IV. Carbon Fibers formed from Solvated Pitch

The as-spun pitch fibers of the present invention will always melt above the solvated pitch spinning temperature. Upon removal of solvent, the fibers of the present invention are typically unmeltable. As a result, the fibers of the present invention frequently do not require chemical stabilization before being carbonized. However, in instances where stabilization is required, it may be performed in significantly shorter periods of time under an atmosphere containing only about 2% to 5% oxygen.

Upon carbonization of the as-spun fibers, the carbon fibers of the present invention can vary from continuous isotropic to continuous anisotropic. However, the majority of any anisotropic regions present in these fibers will not have the highly elongated domains typically characteristic of mesophase pitch carbon fibers. These fibers will have a tensile strength which corresponds to traditional isotropic pitch fibers. To the degree that these fibers contain anisotropic regions, they will possess improved thermal and electrical properties in comparison to completely isotropic fibers.

The following examples are provided to illustrate the present invention. All parts and percentages are by weight unless otherwise specified. The applicant does not wish to be limited by the theory presented within the examples; rather, the true scope of the invention should be determined based on the attached claims.

EXAMPLE 1

A sample of A240 isotropic pitch (8% toluene insolubles by weight; commercially available from Ashland Chemical, Inc., Columbus, Ohio) was mixed with toluene in a stirred autoclave in a ratio of 1 g pitch per 8 cc of solvent. The autoclave was purged with nitrogen, briefly evacuated and sealed. Over a period of 80 minutes the mixture was heated until a temperature of 233° was reached. The mixture was held at the temperature of 233° C. for an additional 10 minutes and stirred. For an additional 15 minutes the mixture was held at 233° C. without stirring and then was permitted to cool. The maximum pressure developed in the closed autoclave during the course of heating was 175 psig.

Solid pitch was recovered from the bottom of the autoclave and the yield of pitch was calculated to be 6.4%. The pitch was analyzed by optical microscopy and was found to contain 5% mesophase in the form of small spheres.

A sample of the solid pitch was dried by heating at 360° C. for 30 minutes under a vacuum. This step removed 28.2% of the volatiles from the pitch. The dried pitch did not soften or melt on heating to 650° C. at the rate of 5° C. per minute under a nitrogen atmosphere on a microscope hot stage.

EXAMPLE 2

A solvated pitch was prepared by combining Aerocarb 80 (30% toluene insolubles by weight) with toluene in a ratio of 1 gram of pitch to 8 ml of toluene. This mixture was stirred for one hour at 230° C., allowed to settle for 15 minutes and then allowed to cool. A layer of dense solid solvated pitch was recovered from the vessel bottom in a 54 percent yield. The solvated pitch was substantially isotropic having only 5 to 10 percent anisotropy by volume in the form of fine spheres and a few larger spheres.

A sample of the solvated pitch was dried for an hour at 150° C. under a vacuum to remove the solvent. Following drying, the pitch had lost 22.1 percent of its weight. The pitch was further heated to 360° C. under a vacuum to remove an additional 4.9% volatiles. This additional loss appears to be due to the removal of any remaining solvent and the loss of some light oils. Analysis of the this sample indicated a total of 52% by volume of anisotropy. This demonstrates that a solvated isotropic pitch will generate additional anisotropy upon loss of solvent.

The fluid temperature of the solvated isotropic pitch was determined by measuring stirring resistance in a small autoclave. A portion of the toluene solvated pitch was heated to a temperature above its fluid temperature, in this instance 235° C. and then cooled slowly at about 1° C. per minute. Using this method, the toluene solvated pitch reached a viscosity of 6000 poise at 191° C. Thus, the fluid temperature of the solvated pitch was 42° C. lower than the melting point of the Aerocarb feed pitch.

Subsequently, the melting and softening points of the solvated pitch following solvent removal were determined through the use of a hot stage microscope. As previously defined, softening occurs at the first rounding of angular features of the pitch particles. Melting occurred when the first observable flow of the softened pitch was seen. Using these procedures and definitions, the dried solvated pitch softened at 323° C. and melted at 328° C. The melting point of the dried solvated pitch was 95° C. higher than the Aerocarb 80 feed pitch. Notably, the difference in melting points between the dried solvated pitch and the fluid temperature of the solvated pitch was at least 137° C. in this experiment.

A sample of the dried solvated pitch and a sample of the Aerocarb 80 pitch were oxidized in order to demonstrate the improved stabilization characteristics of the dried solvated pitch. Samples of both pitches were crushed to 10 to 200 micron particles and oxidized for 30 minutes at a temperature approximately 20° C. lower than their softening points. The oxidizing gas was two percent oxygen in nitrogen. Thus, the Aerocarb 80 feed pitch was oxidized at 205° C. while the dried solvated pitch was oxidized at 300° C. Following oxidation, the softening and melting points of each pitch was determined by heating at 5° C. per minute under nitrogen. The stabilized Aerocarb softened at 250° C. and melted at 254° C., i.e. a 22° C. improvement over the unstabilized pitch. In contrast, the stabilized solvated pitch did not melt and only 20 percent of the sample showed any evidence of softening on heating to 650° C. Clearly, the stabilized solvated pitch has significantly improved thermal characteristics over the stabilized feed pitch. A comparison of the characteristics of the solvated pitch to the non-solvated pitch is provided by the following table.

TABLE 1

| | Aerocarb 80 | Solvated Pitch |
|---|---|---|
| Dried Pitch Characteristics[1] | | |
| Softening Point, °C. | 228 | 323 |
| Melting Point, °C. | 233 | 328 |
| Fluid Temperature of Solvated Pitch[2], °C. | — | 191 |
| Pitch Stabilization (2% $O_2$ in $N_2$) | | |
| Temperature, °C. | 205 | 300 |
| Time, minutes | 30 | 30 |
| Stabilized Pitch Characteristics[1], | | |
| Softening Point, °C. | 250 | <20% to 650 |
| Melting Point, °C. | 254 | none to 650 |

[1]Hot stage observation under $N_2$ at 5° C./minute.
[2]Temperature where viscosity is approximately 6000 poise on cooling.

EXAMPLE 3

This example demonstrates the advantages of carbon fibers spun from the solvated isotropic pitch of Example 3 over fibers spun from the Aerocarb feed pitch. Prior to spinning fibers from the solvated pitch of Example 3, the solvated pitch was resolvated with tetralin. The resolvating step comprised drying the solvated pitch to remove the toluene followed by combining the pitch with tetralin in a 7:2 pitch to solvent ratio. The tetralin solvated pitch was equilibrated at 230° C. for 30 minutes. The resolvated pitch had a fluid temperature of 161° C.

The solvated pitch and the Aerocarb feed pitch were melt spun into fibers. The solvated pitch formed 50 to 60 micron fibers at 187° C. The as-spun fibers from the solvated pitch contained residual solvent. These fibers were heated, under nitrogen, to 290° C. in two minutes and then further heated at 5° C. per minute to determine the softening and melting points of the as-spun fibers. Softening, indicated by rounding of sharp ends and some curvature of the fibers, was observed at 302° C. Melting, indicated by rounding and bulging of fibers ends as well as fusing of fiber junctions, occurred at 353° C. One should note that as-spun fibers will generally soften earlier and melt later than carefully dried fibers.

In contrast to the present invention, the Aerocarb feed pitch required heating to 298° C. prior to spinning into 40 to 60 micron fibers. These as-spun fibers were heated to 200° C. in two minutes and then further heated at 5° C. per minute. These fibers softened at 227° C. and melted at 234° C.

Additionally, both sets of fibers were stabilized. The solvated pitch fibers were stabilized by exposure to two percent oxygen in nitrogen for 60 minutes at 270° C., (83° C. higher than the spinning temperature). The fibers were then raised to 650° C. by heating at 20° C. per minute under nitrogen. The fibers did not soften or melt. The Aerocarb feed pitch fibers were exposed to the same oxygen containing gas at 195° C. for 60 minutes. Note: a lower temperature is necessitated due to the melting point of these fibers. On raising the temperature at 20° C. per minute under nitrogen, these fibers softened at 248° C. and melted at 258°. As shown in Table 2, these results clearly demonstrate the improved ease of stabilization and lower spinning temperatures achievable with solvated pitches.

TABLE 2

| | Aerocarb 80 | Solvated Pitch |
|---|---|---|
| Melt spinning temperature, °C. | 298 | 187 |
| As Spun Melting Behavior[1] | | |
| Softening, °C. | 227 | 302 |
| Melting, °C. | 234 | 353 |
| Fiber Stabilization (2% $O_2$ in $N_2$) | | |
| Temperature, °C. | 195 | 270 |
| Time, minutes | 60 | 60 |
| Stabilized Fiber Characteristics[2], | | |
| Softening Point, °C. | 248 | none to 650 |
| Melting Point, °C. | 258 | none to 650 |

[1]Hot stage observation under $N_2$ at 5° C./minute.
[2]Hot stage observation under $N_2$ at 20° C./minute.

Further, embodiments of the present invention will be apparent to those skilled in the art from a consideration of this specification or practice of the invention disclosed herein. It is intended that the specification and examples be considered as only exemplary, with the true scope and spirit of the invention being indicated by the following claims.

I claim:

1. A process for preparing solvated isotropic pitch comprising:

a) mixing an isotropic pitch and a solvent to form a mixture;

b) separating said mixture into a liquid solvent phase and a solvated pitch phase;

c) recovering said solvated pitch phase.

2. The process of claim 1, wherein step a) includes maintaining sufficient temperature and pressure such that all phases present in said mixture are in the liquid state.

3. The process of claim 1, wherein following step b), said solvated pitch while in the liquid state is filtered to remove any insoluble contaminants.

4. The process of claim 1, wherein said solvent is selected from the group of solvents having solubility parameters ranging from about 8.0 to about 11.0.

5. The process of claim 1, wherein said solvent comprises one or more solvents selected from the group consisting of toluene, benzene, xylene, tetralin, tetrahydrofuran, chloroform, heptane, pyridine, quinoline, halogenated benzenes, chlorofluorobenzenes, and 2 and 3 ring aromatic solvents and their partly alkylated and hydrogenated derivatives.

6. The process of claim 1, wherein step c), comprises separating the solvated pitch from said liquid solvent phase by filtration.

7. A process for preparing carbon artifacts from solvated isotropic pitch comprising:

a) mixing an isotropic pitch and a solvent to form a mixture;

b) separating said mixture into a liquid solvent phase and a solvated pitch phase;

c) recovering said solvated pitch phase;

d) forming said solvated pitch into pitch artifacts;

e) carbonizing said pitch artifacts at a temperature less than the softening point of said pitch artifact.

8. The process of claim 7, wherein said solvent of step a) is selected from the group of solvents having solubility parameters ranging from about 8.0 to about 11.0.

9. The process of claim 7, wherein said solvent of step a) comprises one or more solvents selected from the group consisting of toluene, benzene, xylene, tetralin, tetrahydrofuran, chloroform, heptane, pyridine, quinoline, halogenated benzenes, chlorofluorobenzenes, and 2 and 3 ring aromatic solvents and their partly alkylated and hydrogenated derivatives.

10. The process of claim 7, wherein following step c), said solvated pitch is dried to remove said solvent, followed by resolvating said pitch with a solvent suitable for forming pitch artifacts.

11. The process of claim 10, wherein said solvent suitable for forming carbon artifacts comprises one or more solvents selected from the group consisting of toluene, benzene, xylene, tetralin, tetrahydrofuran, chloroform, heptane, pyridine, quinoline, halogenated benzenes, chlorofluorobenzenes, and 2 to 4 ring aromatic solvents and their partly alkylated and hydrogenated derivatives.

12. The process of claim 7, wherein step d) comprises spinning said pitch into fibers at a temperature lower than the melting point of the solvated pitch in the non-solvated state.

13. The process of claim 7, having the additional step of stabilizing said artifacts by heating said artifacts in the presence of an oxidizing agent.

14. The process of claim 13, wherein said stabilizing step takes place under an atmosphere containing less than five percent oxygen.

15. The process of claim 13, wherein said stabilizing step takes place at a temperature lower than the temperature of artifact formation.

16. The process of claim 7, wherein step a) includes maintaining sufficient temperature and pressure such that all phases present in said mixture are in the liquid state.

17. The process of claim 7, wherein following step b), said solvated pitch while in the liquid state is filtered to remove any insoluble contaminants.

18. The process of claim 7, wherein step c), comprises separating said solvated pitch from said liquid solvent phase by filtration.

19. The process of claim 7, following step d) and prior to step e) having the additional step of drying said pitch artifact.

20. The process of claim 7, having the additional step of carbonizing said artifacts.

21. The process of claim 7, wherein following step c), a solvent having a higher boiling point than the boiling point of said solvent of step a) is combined with said solvated pitch followed by heating said combination to a temperature greater than the boiling point of said step a) solvent in order to drive off said step a) solvent.

22. The process of claim 7, wherein said carbon artifact is a carbon fiber.

23. A solvated isotropic pitch comprising:

a) from about 5% to about 40% solvent by weight;

b) at least 50% by weight toluene insolubles; and c) having a fluid temperature at least 40° C. lower than the nonsolvated pitch.

24. The solvated isotropic pitch of claim 23, wherein said pitch has less than 40% optical anisotropy by volume.

25. The solvated isotropic pitch of claim 23, wherein said pitch is unmeltable upon loss of solvent.

26. A pitch fiber prepared from a solvated isotropic pitch containing from about 5% to about 40% solvent by weight, said pitch fiber being unmeltable upon removal of solvent from said fiber.

27. A pitch fiber prepared from a solvated isotropic pitch containing from about 5% to about 40% solvent by weight, wherein said carbon fiber after solvent removal will oxidize when exposed to an atmosphere containing between about 2% to 5% oxygen and heated at a temperature greater than said fiber's temperature of formation.

* * * * *